US005761888A

United States Patent [19]

Haley

[11] Patent Number: 5,761,888

[45] Date of Patent: Jun. 9, 1998

[54] METHOD AND APPARATUS FOR CONVEYING DRY ICE

[75] Inventor: David Edward Haley, Conyers, Ga.

[73] Assignee: Carbonic Industries Corporation, Duluth, Ga.

[21] Appl. No.: 715,699

[22] Filed: Sep. 19, 1996

[51] Int. Cl.[6] ..... B65B 1/12; B65B 1/32; B65B 37/10; B65B 57/02

[52] U.S. Cl. ..... 53/502; 53/251; 53/473; 53/506; 198/580; 198/657

[58] Field of Search ..... 53/502, 473, 475, 53/251, 250, 249, 235, 67, 64, 506, 505; 198/580, 670, 657, 957, 467.1, 611, 603, 625

[56] References Cited

U.S. PATENT DOCUMENTS

| | | | |
|---|---|---|---|
| 2,536,516 | 1/1951 | Peterson | 53/502 X |
| 3,498,020 | 3/1970 | Eppenberger | 53/502 X |
| 3,807,193 | 4/1974 | McKenny et al. | 53/502 X |
| 4,003,115 | 1/1977 | Fisher | 198/658 X |
| 4,074,507 | 2/1978 | Ruf et al. | 53/502 |
| 4,528,098 | 7/1985 | Treyssac et al. | 210/414 |
| 5,109,651 | 5/1992 | Stuart | 53/502 |
| 5,190,140 | 3/1993 | Buschbom | 198/642 |
| 5,277,016 | 1/1994 | Williams et al. | 53/502 X |
| 5,281,071 | 1/1994 | Crabb, Jr. | 414/310 |
| 5,299,427 | 4/1994 | Miller et al. | 62/66 |
| 5,301,795 | 4/1994 | Persson | 198/773 |
| 5,473,865 | 12/1995 | Tanaka et al. | 53/506 X |

*Primary Examiner*—James F. Coan
*Attorney, Agent, or Firm*—Deveau, Colton & Marquis

[57] ABSTRACT

A method and apparatus for distributing dry ice from a central source, through a distribution network of feed conveyors, to one or more remote dispensing stations where the dry ice is dispensed into packaging containers. The feed conveyors are provided with low-friction material ice-contacting surfaces to prevent clumping and sticking of the ice. A programmable electronic controller enables automatic dispensing of batches of predetermined quantities of dry ice to the packaging containers.

20 Claims, 3 Drawing Sheets

METHOD AND APPARATUS FOR CONVEYING DRY ICE

BACKGROUND OF THE INVENTION

1. Field of the Invention

The present invention relates generally to a method and apparatus for conveying and dispensing pellets or granules of materials into packaging containers. The invention relates more specifically to a method and apparatus for receiving dry ice pellets from a central pellet source, conveying the dry ice via a low-friction auger-and-trough distribution system to one or more remote dispensing locations, weighing the pellets into batches of a predetermined quantity, and dispensing the pellets into packaging containers when called for.

2. Description of Related Art

Dry ice (i.e., carbon dioxide in solid form) is utilized for a variety of cooling applications. Dry ice exists at atmospheric pressure at temperatures of below −78.5° C. As dry ice absorbs heat, it sublimes to a vapor, and does not exist as a liquid at atmospheric pressure.

Because of its low temperature and high heat absorption characteristics, dry ice has been found particularly desirable for use in the packaging of poultry, meats, produce and other perishable items. Materials packaged in dry ice are slightly "crust" frozen, meaning that only the outer surfaces of the materials freeze. This seals in moisture and flavor without deep freezing, which may adversely affect the flavor and/or texture of the packaged products.

A distinct advantage of dry ice packaging over normal "wet" ice (i.e., frozen water) is that dry ice sublimes, rather than melts to a liquid. This eliminates, or greatly reduces, the necessity for drainage and cleaning during transportation and storage. Savings are also realized due to reduced weight during transportation. Water damage to the packaging containers is reduced by the elimination of melt water, thus enabling greater re-use and/or recycling of boxes and other packaging materials, as well as the use of lower cost materials. It has also been found that bacteria growth is inhibited by the physiological effects of the carbon dioxide, as well as by the low temperature of the dry ice and the reduction or elimination of standing melt water.

Previously, the application of dry ice to poultry, meat and produce packaging has been achieved primarily by manually scooping or shoveling dry ice pellets from an insulated container into the packaging boxes. Dry ice pellets are commonly produced by a dry ice pellet extruder which deposits the dry ice pellets into an insulated container. According to previously known manual packaging processes, the filled container is then moved, typically by fork lift, to the desired point of use along the packaging line. Once delivered to the point of use, the dry ice pellets are scooped into the product's packaging manually with a scoop or shovel.

Several disadvantages have been found to inhere in known prior art methods of packaging materials with dry ice. First, in many packaging facilities there is insufficient floor space to permit forklift access to the individual packaging stations where dry ice is needed. This is commonly the situation in existing packaging plants where floor space is at a premium due to the quantity and layout of the processing and packaging equipment present. In this event, dry ice pellets must be hand-carried in small containers from a central storage bin to each remote packaging station. This greatly increases labor costs, and results in reduced productivity.

Further disadvantages of known manual methods for packaging materials with dry ice include the introduction of contaminants due to the use of open containers and scoops, and the loss of dry ice through sublimation due to the use of containers which must be open to the warm ambient surroundings while ice is scooped therefrom.

Automated systems for storing and dispensing ice are known, each having been found to be less than completely acceptable in meeting the objectives of the present invention. For example, U.S. Pat. No. 5,299,427 to Miller, et al. discloses an ice transport and dispensing system wherein an icemaker dispenses ice into a storage bin. Ice from the storage bin is distributed through conduits, under the influence of gravity, to a plurality of ice dispenser stations.

The use of gravity-fed distribution systems has been found less than adequate in many applications. For example, gravity-fed systems require sufficient slope in the ice delivery conduits to ensure a steady flow of ice therethrough. This requirement effectively limits the horizontal distance over which ice may be distributed as a function of the height of the central storage bin above the remote dispensing stations. Thus, if it is desired to distribute ice to dispensing stations which are horizontally removed from one another, it may be necessary to install multiple dispensing systems throughout the packaging facility, or to construct an elevated support for the central storage bin. Either approach will generally result in increased costs.

U.S. Pat. No. 5,281,071 to Crabb, Jr. discloses a portable ice storage and dispensing system. The system includes a storage bin, a traversing auger for cutting the ice from an ice mass within the bin, and a discharge conveyor which ejects the ice to the exterior of the bin. This system has also been found to be less than entirely satisfactory for dispensing dry ice pellets to the packaging of perishable products. It has been found, for example, that ice pellets may stick to the auger and auger housing due to the condensation and refreezing of moisture. Also, it has been found desirable to provide a more accurate and automated control of the conveying and dispensing of dry ice pellets than is permitted by the storage and dispensing system of Crabb, Jr.

Thus it can be seen that a need yet exists for a method for conveying and dispensing dry ice from a pellet machine or central storage hopper to one or more remote dispensing stations.

It has also been found that a need exists for an automated method of dispensing accurately measured batches of a predetermined quantity of dry ice pellets into a produce box via a batch weighing process.

A need also exists for an apparatus for conveying dry ice from a dry ice pellet machine or a central storage hopper to one or more remote dispensing stations.

A need further exists for such an apparatus which minimizes or eliminates the occurrence of dry ice pellets sticking to the parts of the conveying apparatus.

It has also been found that a need exists for an apparatus which is capable of preventing contamination of the ice and maintaining the dry ice contained therein in a thermally-insulated environment until the dry ice is dispensed into the individual produce boxes.

A need further exists for a dry ice distribution and dispensing device which enables the batch weighing of a predetermined quantity of dry ice pellets and the automated dispensing of the weighed batches of dry ice into produce boxes during packaging.

It is to the provision of a method and apparatus meeting these and other needs that the present invention is primarily directed.

SUMMARY OF THE INVENTION

Briefly described, in a preferred form, the present invention comprises a method for conveying dry ice or other materials from a dry ice pellet extruder or a central dry ice storage hopper, via a distribution network of troughs or conduits which house motor driven augers, to one or more remote dispensing stations. The screw or flights of the augers used by the method of the present invention are constructed of, or are coated with, a low-friction material, such as a polyolefin and/or a polyurethane to prevent the sticking of dry ice pellets due to moisture condensation and freezing. Suitable polyolefins include polyethylene and polypropylene, with ultra-high molecular weight (UHMW) polyethylene being preferred. The trough or conduit is provided with a liner also of the low friction material. The method of the present invention further comprises batch weighing of the dry ice at the remote dispensing station and automated discharge of batches of a predetermined quantity of dry ice into packaging containers which are conveyed along an assembly line which passes beneath the dispensing station.

The present invention further comprises an apparatus for distributing and dispensing dry ice or other materials into packaging containers. The apparatus comprises a distribution network of troughs or conduits for conveying dry ice from a pellet extruder or a central storage hopper to one or more remote dispensing stations. The troughs or conduits of the apparatus are lined with the low-friction material to prevent sticking of the dry ice therein. Motor driven augers are provided within the troughs or conduits to convey the dry ice pellets to the remote dispensing stations. The auger screw or flight assembly is constructed of or coated with the low-friction material as well. The troughs or conduits of the apparatus of the present invention are thermally insulated by means of an airspace provided between the outer trough housing and the low friction liner. The trough is covered to provide further thermal insulation and to prevent contamination from entering the troughs or conduits. Exhaust ports are preferably provided in the trough covers for exhausting $CO_2$ vapor generated by the sublimation of dry ice. A vacuum-assisted fume exhaust system can be provided.

In preferred form, the conveyors of the distribution network of the present invention are suspended from the ceiling of the packaging facility in order to minimize the amount of floor space occupied. The present invention also enables the dry ice production machine and/or the central dry ice storage bin to be located remotely from the points of dry ice application in the packaging facility. This allows maintenance and repair of this equipment without interference with the remainder of the packaging operation, and frees up additional floor space in the vicinity of the packaging equipment.

Flow of the dry ice pellets to the remote dispensing stations can be controlled by, for example, pneumatically operated slide gates, the material-contacting surfaces of which are also preferably coated with the low-friction material. The remote dispensing stations also preferably include a load cell and batch weighing and discharge means for automated control of the quantity of dry ice discharged to each package.

Accordingly, it is an object of the present invention to provide a method for conveying and dispensing dry ice from a central location to one or more remote dispensing stations.

It is another object of the present invention to provide a method and apparatus which enable accurate automated control of the batch size of dry ice discharged from the remote dispensing stations.

A further object of the present invention is to provide a method and apparatus for the automated distribution of dry ice from a central production or storage location to one or more remote dispensing stations, whereby sticking and fusion of the dry ice pellets to one another and to the internal ice-contacting surfaces of the apparatus is minimized.

Still another object of the present invention is to provide a method and apparatus for the distribution and dispensing of dry ice which maintains the dry ice in a thermally insulated enclosure throughout substantially the entire distribution process, and which prevents the introduction of external contaminants to the dry ice.

Another objective of the present invention is to provide a method and apparatus for conveying and dispensing dry ice which can be installed to cooperate with pre-existing packaging equipment, and which minimizes the amount of floor space within the packaging facility occupied by the dry ice distribution system.

These and other objects, features, and advantages of the present invention will become more apparent upon reading the following specification in conjunction with the accompanying drawing figures.

DESCRIPTION OF THE DRAWING FIGURES

DESCRIPTION OF A PREFERRED EMBODIMENT

Figure 1:
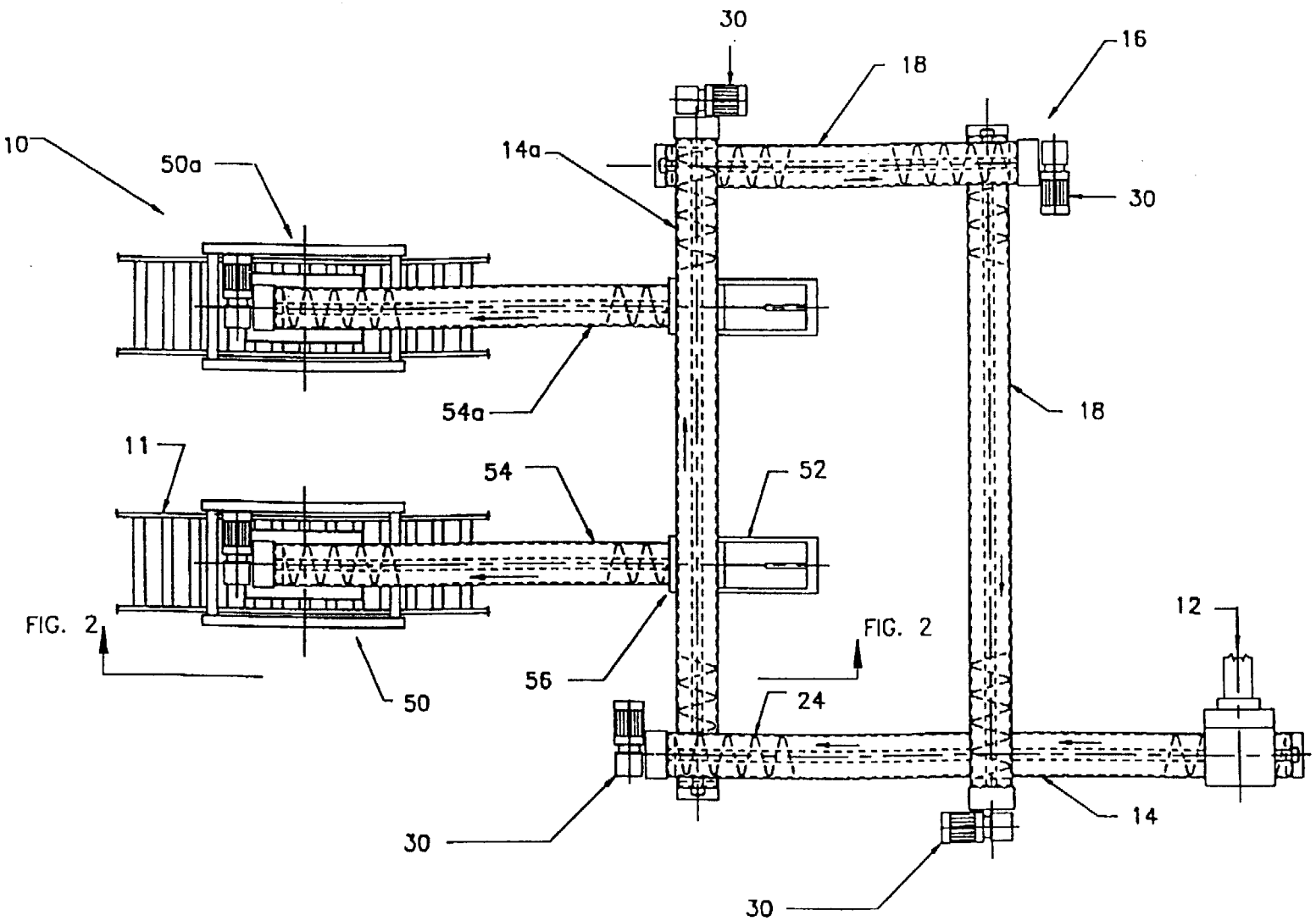
FIG. 1 is a top plan view of a dry ice distribution and dispensing system according to a preferred form of the present invention.

Referring now in detail to the drawing figures wherein like reference numerals represent like parts throughout several views, FIG. 1 shows a dry ice distribution and dispensing system 10 according to a preferred form of the present invention. Dry ice 12 from a pellet extruder or a central storage hopper (unshown) is introduced to a feed conveyor 14 which forms part of a dry ice distribution network 16. Any number of branch feed conveyors **14*a* can be fed with dry ice from feed conveyor 14, depending upon the number and locations of desired dry ice discharge stations. Recycle conveyors 18, 18*a* can also be provided to return excess dry ice to the feed conveyors 14, 14*a*. Alternatively, the feed conveyors 14, 14*a* can be deadheaded directly following the last use point in the distribution network 16**.

Figure 3:
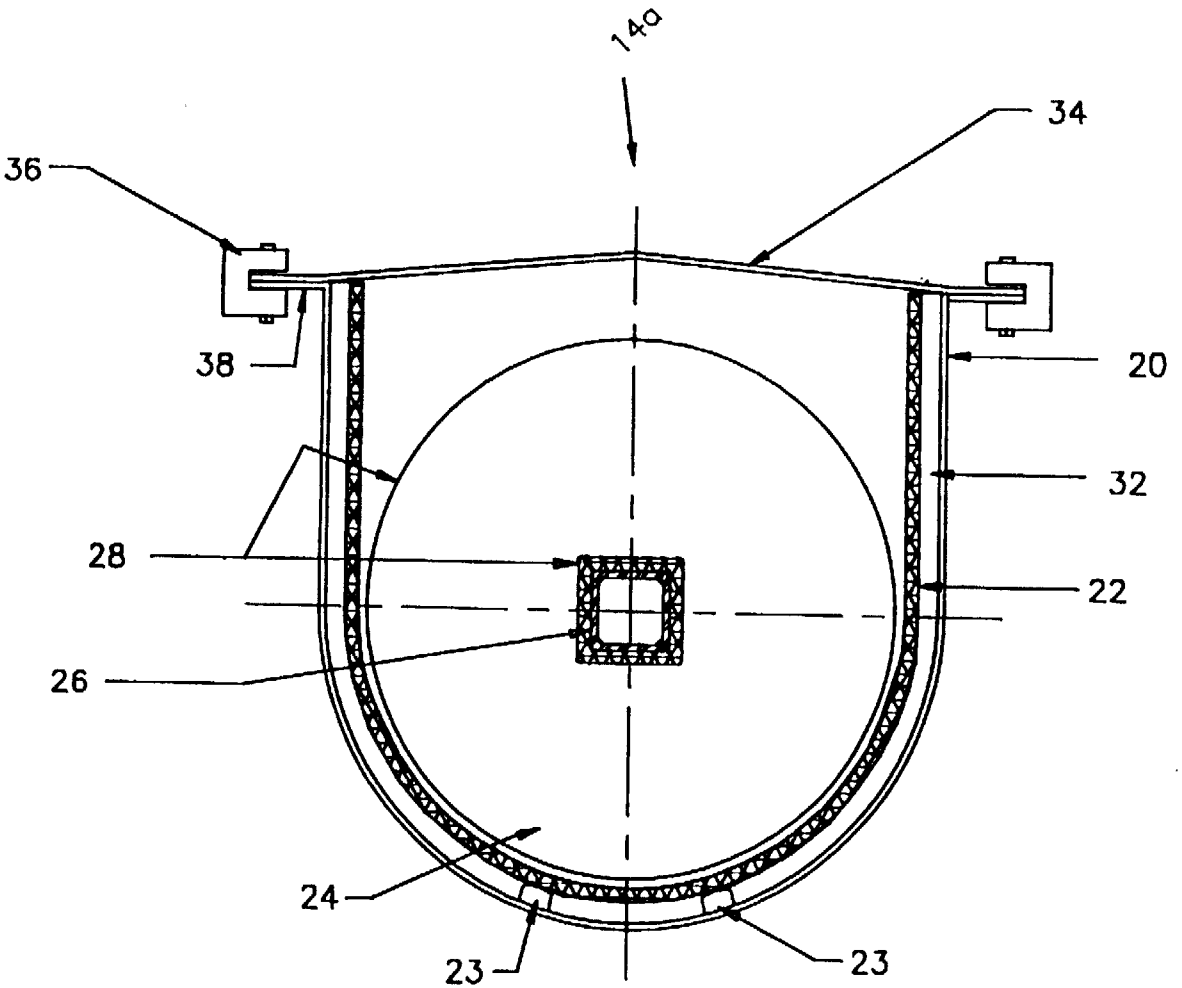
FIG. 3 is a cross-sectional detail of a typical dry ice conveyor portion of the present invention according to a preferred form.

Feed conveyors 14, **14*a* and recycle conveyors 18, 18*a* are preferably galvanized or stainless steel troughs 20**, as shown in greater detail by FIG. 3. Alternatively, tubular conduits or open or closed conduits of various cross-sections can be utilized. The troughs need not be made of galvanized or stainless steel. Any corrosion resistant USDA approved material will suffice.

A low friction liner 22 is preferably provided along the interior surfaces of the trough 20 to prevent ice from sticking to the trough, to provide greater thermal insulation, and to facilitate more efficient propulsion of the ice through the distribution network 16. Suitable materials for the low friction liner 22 include polyolefins and polyurethane. Suitable polyolefins include polyethylene and polypropylene. The liner 22 is preferably constructed of an ultra-high molecular weight (UHMW) polyethylene polymer, which presents a low coefficient of friction to the dry ice. Liner 22 can alternatively comprise a base layer of steel or other material coated with the low material in the form of a cladding on its interior surface.

Material is conveyed within each of the feed conveyors 14, 14*a* and the recycle conveyors 18, 18*a* by means of a rotating auger 24. An auger 24 extends throughout substantially the entire length of the trough 20 of each conveyor. Auger 24 generally comprises an axial shaft 26 and helical vanes or screw flights 28, circumferentially mounted thereto. A drive motor 30 is preferably coupled to one end of the shaft 26 to rotationally drive the auger 24 and thereby propel dry ice along the helical vanes or screw flights 28, and through the trough 20.

In preferred form, the shaft 26 of auger 24 is constructed of steel, most preferably stainless steel, or of other USDA approved corrosion resistant material of sufficient strength to allow the auger 24 to break up any clumps of dry ice within the conveyors. The ice-contacting surfaces of the shaft 26 are preferably coated with the above-referenced low friction material to prevent sticking of ice thereto. The helical vanes or screw flights 28 of the auger are most preferably constructed of UHMW polyethylene material, such as that described above, or alternatively, are provided with a coating of such material. As seen best in FIG. 3, at least the lower portion of liner 22 should closely match the exterior profile of the vanes or screw flights 28 of the auger 24, so that the auger will act to propel substantially all of the material contained within the trough 20 as the auger is rotationally driven.

In its preferred form, the apparatus of the present invention achieves improved thermal insulation within the conveyors by providing an air space 32 between the trough 20 and the liner 22. Spacer means such as PVC shims 23 can be provided between the liner 22 and the trough 20 to create and maintain the air space 32. In some applications, it may be desirable to run refrigerant lines through the air space 32, or to fill the air space 32 with an insulating material.

In preferred form, each of the troughs 20 of the present invention is enclosed by means of a cover 34. Cover 34 prevents external contamination from entering the trough 20, and provides improved thermal insulation. In its preferred form, cover 34 is fabricated from galvanized or stainless steel or other USDA approved corrosion resistant material. Cover 34 can further comprise an insulating layer, and/or a coating of low friction material, such as that described above, on its lower surface. Clamps 36 secure the cover 34 to flanges 38 on the trough 20. By removing clamps 36, cover 34 can be readily removed to permit access to the interior of trough 20 for observation, troubleshooting and repairs. Drain holes or slots can be provided through the cover 34 close to the edge over flange 38, or at various locations on the trough 20 to permit condensate accumulating within the distribution network 16 to drain. When used, the holes or slots should be placed so as to avoid condensate from running into the conveyor. In place of the holes or slots, the cover 34 may be bent, such as shown in FIG. 3, to allow condensate to run off.

The dry ice distribution system 10 of the present invention can further comprise a vacuum-assisted $CO_2$ fume exhaust system. Preferably, the fume exhaust system comprises one or more exhaust ports (unshown) along the cover 34. The exhaust ports will preferably be located at least in the vicinity of low points of elevation along the distribution network 16. exhaust system comprising fume exhaustors (unshown) can be provided to pull a vacuum on the $CO_2$ exhaust ports and exhaust the fumes to the external atmosphere.

Depending upon the size and layout of the packaging facility where the method and apparatus of the present invention are utilized, the distribution network 16 includes one or more feed conveyors 14, and optionally, one or more recycle conveyors 18. In the embodiment of the present invention depicted by FIG. 1, for example, two feed conveyors are provided, and are designated by reference numerals 14 and 14*a*. Likewise, two recycle conveyors are depicted in the embodiment of FIG. 1, namely elements 18 and 18*a*. It will be readily apparent to those of ordinary skill in the art, however, that any number and configuration of conveyors may be utilized, as necessary, to convey dry ice to the various remote dispensing stations throughout the packaging facility. It will also be understood by those of ordinary skill in the art that the distribution network 16 of the present invention can be of virtually any length. Moreover, various rates of dry ice supply can be achieved by increasing or decreasing, as appropriate, the conveyor diameters, the auger motor speeds, and/or the auger motor gearing.

Where it is necessary to transfer dry ice from one conveyor to another, a transition coupling or aligned openings (unshown) can be provided between the conveyors to introduce dry ice discharged from the outlet of one conveyor to the inlet of another. For example, in the embodiment shown by FIG. 1, dry ice will be transferred from feed conveyor 14 to feed conveyor 14*a*; from feed conveyor 14*a* to recycle conveyor 18; from recycle conveyor 18 to recycle conveyor 18*a*; and from recycle conveyor 18*a* back into feed conveyor 14. As will be understood by those of ordinary skill in the art, it may be necessary to orient certain of the conveyors within the distribution network 16 at an angle of inclination to permit gravity discharge from the outlet of one conveyor to the inlet of another.

Isolation means, such as remotely operable slide gate valves, can be provided at the transfer couplings to allow certain segments of the distribution network to be shut down, as for maintenance or due to production demands, while the remainder of the distribution network remains in operation or vice versa.

In preferred form, the conveying equipment of the present invention is suspended from the ceiling of the processing facility in order to minimize the amount of floor space necessary. This can be accomplished, for example, by means of hangers and brackets extending between ceiling beams of the processing facility and the conveyors. Alternatively, floor or wall mounted supports can be provided.

Figure 2:
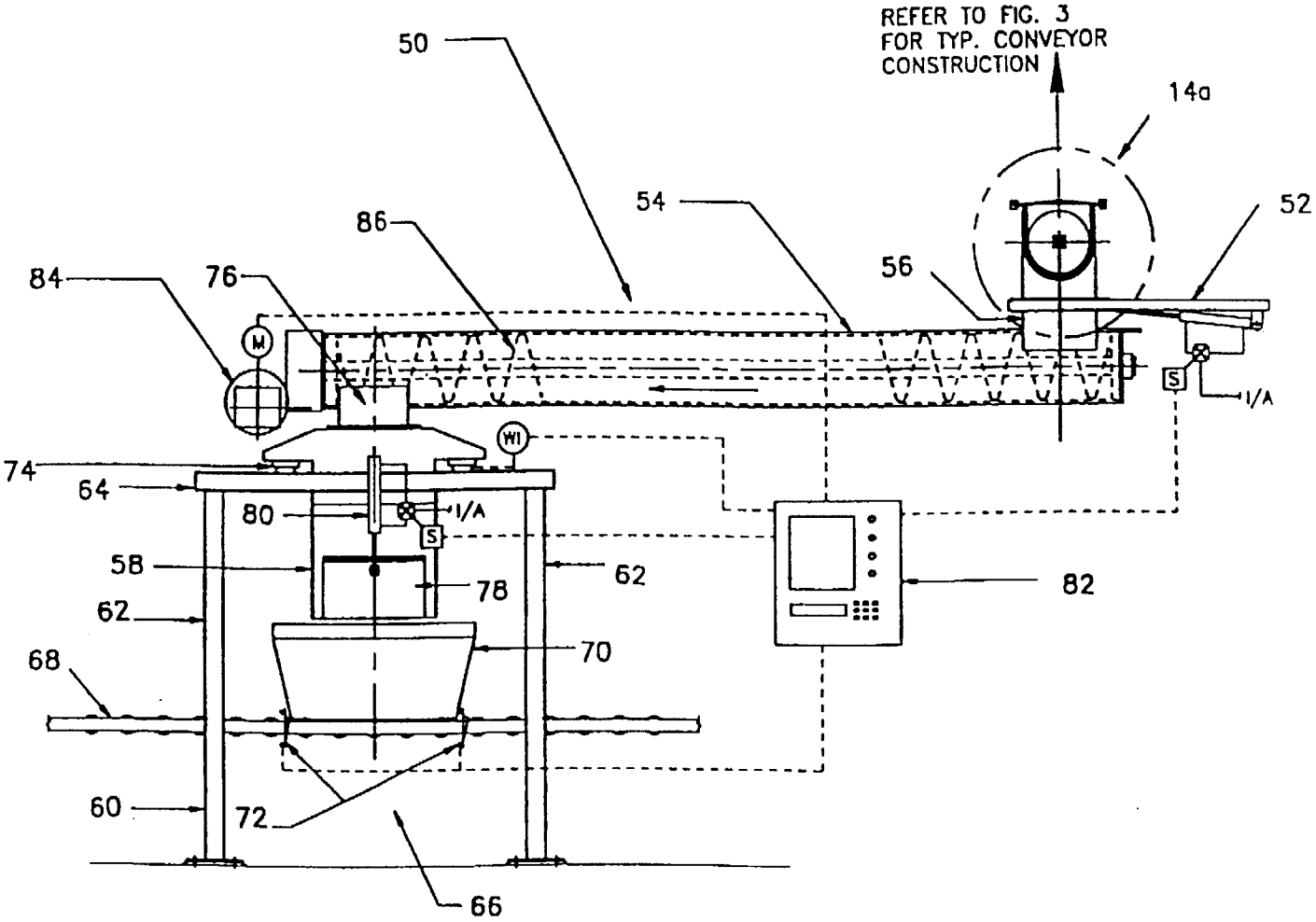
FIG. 2 is a side elevational view of a remote dispensing station according to a preferred form of the present invention.

Dry ice is supplied by the distribution network 16 to one or more remote dispensing stations 50, 50*a*, located throughout the packaging facility as necessary. The arrangement of a typical remote dispensing station 50, according to a preferred form, is seen best in FIGS. 1 and 2. The quantity and arrangement of remote dispensing stations 50 will depend upon and correspond to the layout of the processing facility in which the method and apparatus of the present invention are utilized. Generally, at least one remote dispensing station will be provided near the end of each packaging line at the point where dry ice is to be delivered to the product packaging.

Valves or slide gate isolation dampers 52 control the discharge of dry ice from the feed conveyors 14, 14*a* to a dispensing station conveyor 54, associated with each remote dispensing station 50. Dispensing station conveyors 54, are generally of a construction substantially identical to the feed conveyors 14, 14*a* and recycle conveyors 18, 18*a* as described above, and as depicted in cross-section by FIG. 3. A transition coupling 56 can be provided between feed conveyor 14*a* and dispensing station conveyor 54 at the point where dry ice is transferred. The dispensing station conveyor 54 conveys dry ice received from feed conveyor 14*a* to a dump hopper 58.

A support frame 60, preferably comprising upright legs 62 and a horizontal platform 64, supports the dump hopper 58 above an ice application station 66 near the end of a packaging line within the packaging facility. The support frame 60 is preferably constructed of stainless steel, or of other material of sufficient strength and corrosion resistance to support the dump hopper 58 and associated equipment.

The method and apparatus of the present invention can be used with any of a variety of packaging lines, and can be retrofit to preexisting packaging lines as well as built into newly-constructed facilities. The packaging line depicted in the figures, for example, comprises a roller conveyor 68 for conveying packaging containers 70 which have been loaded with perishable materials. One or more limit switches 72 can be provided along the roller conveyor 68 to indicate when packaging containers 70 have reached a position corresponding to the ice application station 66.

At least one load cell 74 is operably connected between the support platform 64 and the dump hopper 58. In this manner, the quantity of dry ice contained within the dump hopper can be accurately measured by remote electronic means. As an alternative to the load cell 74, one or more level sensors can be provided on the interior surface of the dump hopper 58 for measuring the level of dry ice contained therein. In order to minimize weighing errors, and interference induced by vibrations from the rotation of the dispensing station conveyor auger 86, it is preferable that the coupling 76 between the dispensing station conveyor 54 and the dump hopper 58 be constructed of a flexible material. Alternatively, the dispensing station conveyor 54 can be suspended above, and out of physical contact with, the dump hopper 58.

A hinged discharge door 78 is provided at the lower end of the dump hopper 58. When the discharge door 78 is opened, dry ice contained within the dump hopper 58 can discharge therefrom by gravity. When the discharge door 78 is closed, dry ice accumulates within the dump hopper 58 as it is received from the dispensing station conveyor 54. A pneumatic cylinder 80 is provided which can be actuated to open and close the discharge door 78.

A controller 82 is preferably provided to automatically control various aspects of the operation of the remote dispensing station 50. Manual overrides for some or all of the automated control functions can be provided. The controller 82 preferably comprises a computer for storing a variety of information input thereto, and for sending and receiving signals to and from various elements of the system 10. For example, controller 82 can be configured to receive and recognize an electronic signal from the limit switches 72, and thereby recognize when a packaging container 70 has reached the ice application station 66. The controller 82 can also signal the roller conveyor 68 to pause the packaging container 70 in position beneath the discharge door 78 of the dump hopper 58 during ice application. The controller 82 can also be programmed to automatically actuate the pneumatic cylinder 80 to open the discharge door 78 when a packaging container 70 is properly positioned under the dump hopper 58.

In the preferred form of the present invention, the controller 82 is also configured to receive and process signals from the load cell 74, so that when the dump hopper 58 has emptied its contents into the packaging container 70, pneumatic cylinder 80 is actuated to close the discharge door 78. Once the discharge door 78 has been closed, the controller 82 reactivates the roller conveyor 68 to send the packaging container 70, into which dry ice has been applied, on to the next step in the packaging line. The dispensing station 50 is then ready to receive the next packaging container 70 on the roller conveyor 68.

Upon closing of the discharge door 78, the controller 82 signals the slide gate valve 52 to open, thereby permitting dry ice from feed conveyor 14*a* to be fed into the dispensing station conveyor 54 through the transition coupling 56. Controller 82 also signals the dispensing station conveyor gear motor 84 to activate and rotationally drive the dispensing station conveyor auger 86 to propel dry ice through the dispensing station conveyor 54, to discharge into and accumulate within the dump hopper 58. Load cell 74 monitors the accumulation of dry ice within the dump hopper 58 and relays this information to the controller 82. The size of batches of dry ice to be accumulated within the dump hopper 58 and discharged into packaging containers 70 can be easily adjusted by keying in the desired weight set point on the controller's 82 keyboard. Alternatively, if level sensors are provided within the dump hopper 58, the batch set point will correspond to a level signal transmitted to the controller 82 by the level sensor or sensors.

The controller 82 is preferably programmed to enable batch weighing of dry ice within the dump hopper 58. Thus, when the load cell 74 sends a signal to the controller 82 indicating that a predetermined set point has been reached, the controller 82 sends a signal to actuate the slide gate valve 52 to close. Approximately simultaneously, the controller 82 signals the dispensing station conveyor gear motor 84, and/or an unshown braking mechanism to stop the rotation of the dispensing station conveyor auger 86.

Once a full batch of dry ice has accumulated within the dump hopper 58, the controller 82 will poll the signal input from the limit switches 72 to determine whether a packaging container 70 is positioned at the ice application station 66 beneath the discharge door 78. If a packaging container 70 is in position and ready to receive a batch of dry ice, the pneumatic cylinder 80 will be actuated to open the discharge door 78 thereby discharging a batch of dry ice into the waiting packaging container 70. In the event that the controller receives a signal from the limit switches 72 indicating that no packaging container 70 has yet been received into position at the ice application station 66, the controller will place the dispensing station in a "ready-to-discharge" mode, wherein upon the receipt of a packaging container 70, the pneumatic cylinder will actuate to open discharge door 78 and discharge a batch of dry ice to the packaging container 70.

In operation, the apparatus of the present invention enables the practice of a method of conveying dry ice to a plurality of remote in-plant locations while preventing fusion of the dry ice pellets. This method will now be described.

The method of the present invention initially comprises accumulating a quantity of dry ice 12 or other packaging materials at a central storage location. For example, dry ice 12 can be produced by a dry ice pellet production machine, or can be delivered from a remote location and is stored in a central storage hopper or other container.

The dry ice is then transferred from the central storage container to a distribution network 16, which distributes the dry ice to the required locations within a packaging facility. The distribution of the dry ice is carried out within the distribution network by feed conveyors 14, 14*a* as described above. Recycle conveyors 18, 18*a* can also be provided to return unused dry ice to the feed conveyors 14, 14*a*. To facilitate more efficient distribution of the dry ice within the distribution network, the feed conveyors and, if utilized, the recycle conveyors are provided with the low-friction material-contacting surfaces.

Dry ice is transferred from the feed conveyors 14, 14*a* to one or more remote dispensing stations 50, 50*a*. The remote dispensing stations 50, 50*a* can be isolated from the feed conveyors 14, 14*a* by means of isolation valves or dampers 52. The valves 52 are opened to allow dry ice to pass therethrough during the filling of the dump hopper, and are closed when a batch of dry ice has been dispensed into the dump hopper.

A dispensing station conveyor 54 conveys dry ice from the feed conveyor 14*a* to the dump hopper 58. Batches of predetermined quantities of dry ice are accumulated within the dump hopper 50 by means of the above described controller 82 and associated equipment. In its preferred form, the method of the present invention comprises weighing the dump hopper 58 by means of a load cell 74 to determine when a predetermined weight set point has been reached, indicating that the dump hopper 58 contains a full batch of dry ice. Once the set point is reached, indicating a batch of dry ice has been dispensed into the dump hopper, the dispensing station conveyor is stopped, and no more dry ice is transferred. It will be understood by those skilled in the art that the automated method of the present invention enables more precise control over the amount of dry ice applied to each packaging container than is permitted by previously known manual dry ice application methods. This permits greater quality control, reduced overall usage of dry ice and a savings in labor costs.

A series of packaging containers is conveyed along a packaging line conveyor which passes beneath the remote dispensing station 50 at an ice application station 66. When one of the packaging containers reaches the ice application station, the packaging container activates one or more limit switches, which in turn signal a central controller that the packaging container is in position for ice application.

The central controller then actuates a pneumatic cylinder to open a discharge door of a dump hopper, causing a batch of dry ice pellets contained within the dump hopper to discharge into the packaging container. A load cell operatively coupled to the dump hopper signals the central controller when the dump hopper has emptied its contents, whereupon the central controller actuates the pneumatic cylinder to close the discharge door of the dump hopper. Alternatively, the opening and closing sequence can be controlled by a timer means. The roller conveyor is then reactivated to send the iced packaging container onto the next station of the packaging line, and to convey the next packaging container into the ice application station. The dispensing cycle then repeats, filling the dump hopper 58 with another batch of dry ice to be dispensed into the next packaging container.

While the invention has been disclosed in its preferred forms, it will be readily apparent to those skilled in the art that many modifications, additions, and deletions can be made therein without departing from the spirit and scope of the invention as set forth in the following claims.

What is claimed is:

1. An apparatus for the application of packaging materials to packages of products, said apparatus comprising:

(a) a distribution network comprising at least one feed conveyor for conveying the packaging materials from a material source, each said feed conveyor further comprising a housing, an auger within said housing, and means for rotating said auger, said housing and said auger each having surface portions comprising a low friction material; and (b) at least one remote dispensing station for receiving the packaging materials from said feed conveyor, accumulating the packaging materials into batches of a predetermined quantity, and discharging the batches into the packages of products, said remote dispensing station comprising a dump hopper in which the batches are collected, means for transferring the packaging materials from said distribution network to said dump hopper, means operatively connected to said dump hopper for determining the quantity of packaging materials therein, and means connected to said dump hopper for discharging the packaging materials within said dump hopper into the packages of products.

2. The apparatus of claim 1, wherein said packaging materials comprise dry ice pellets.

3. The apparatus of claim 1, wherein said distribution network further comprises at least one recycle conveyor for returning unused packaging materials to said at least one feed conveyor.

4. The apparatus of claim 1, wherein said housing comprises a generally trough-shaped portion, and said low friction material portion of said housing comprises a liner within said generally trough-shaped portion.

5. The apparatus of claim 4, further comprising an air space between said generally trough-shaped portion and said liner.

6. The apparatus of claim 4, wherein said housing further comprises a cover portion and means for releasably attaching said cover portion to said generally trough-shaped portion.

7. The apparatus of claim 1, further comprising means for exhausting fumes from said distribution network.

8. The apparatus of claim 7, wherein said means for exhausting comprises at least one exhaust vent communicating with each said feed conveyor, vacuum means for exhausting fumes from said exhaust vent, and an exhaust discharge located remote from said distribution network.

9. The apparatus of claim 1, wherein said means for transferring comprises a dispensing station conveyor having a first input end for receiving the packaging materials from said distribution network and a second output end for discharging the packaging materials to said dump hopper.

10. The apparatus of claim 9, wherein said dispensing station conveyor further comprises a dispensing station conveyor housing, a dispensing station auger within said dispensing station conveyor housing and means for rotating said dispensing station auger, said dispensing station conveyor housing and said dispensing station auger each comprising surface portions comprising a low friction polymer.

11. The apparatus of claim 10, wherein said means for transferring further comprises a slide gate valve between said distribution network and said dispensing station conveyor, said slide gate valve being operable between an open position and a closed position, said open position permitting the packaging materials to pass from said distribution network to said dispensing station conveyor and said closed position preventing the packaging materials from passing from said distribution network to said dispensing station conveyor; and wherein said means for transferring further comprises braking means for stopping the rotation of said dispensing station auger.

12. The apparatus of claim 11, wherein said means for determining the quantity of packaging materials within said dump hopper comprises a load cell.

13. The apparatus of claim 12 wherein said means for discharging comprises a door within said dump hopper and a pneumatic cylinder for opening and closing said door.

14. The apparatus of claim 13 further comprising at least one limit switch beneath said dump hopper for sensing when a package is in an ice application position under said dump hopper.

15. The apparatus of claim 14 further comprising programmable electronic control means operatively connected to said slide gate valve, said means for rotating said dispensing station auger, said load cell, said pneumatic cylinder, and said at least one limit switch.

16. A method for transferring a batch of a predetermined quantity of dry ice from a dry ice source to a packaging container, said process comprising the steps of:

(a) distributing dry ice from the dry ice source throughout a distribution network;

(b) transferring dry ice from said distribution network to a dispensing station;

(c) dispensing a batch quantity of dry ice into a dump hopper at said dispensing station; and (d) discharging the batch quantity of dry ice from said dump hopper into the packaging container, wherein said distribution network comprises low friction material dry ice-contacting surfaces.

17. The method of claim 16, wherein said dispensing station further comprises programmable electronic control means, and wherein said method further comprises programming the control means to automatically control said transferring step, said dispensing step, and said discharging step.

18. The method of claim 17, wherein said dispensing station further comprises means for electronically sensing when the packaging container is in an ice-application position generally beneath the dump hopper, said means for electronically sensing being connected to said programmable electronic control means, whereby said discharging step occurs only when the packaging container is in the ice-application position.

19. The method of claim 18, wherein said dispensing step further comprises weighing the dump hopper by means of a load cell to determine when the dump hopper has received the batch quantity of dry ice.

20. The method of claim 19, wherein said transferring step further comprises opening a slide gate valve to permit dry ice to pass from the distribution network into a dispensing station conveyor, conveying dry ice through the dispensing station conveyor and into the dump hopper, and closing the slide gate valve and halting the conveying of the dry ice in the dispensing station conveyor when the weighing step indicates that the dump hopper has received the batch quantity of dry ice.

* * * * *